US005410904A

United States Patent [19]

Hirata et al.

[11] Patent Number: 5,410,904

[45] Date of Patent: May 2, 1995

[54] BENDING PRESS HAVING DIE STORAGE SECTION

[75] Inventors: Tadashi Hirata, Atsugi; Masayoshi Yanagisawa, Isehara, both of Japan

[73] Assignee: Amada Company, Limited, Japan

[21] Appl. No.: 946,368

[22] PCT Filed: Mar. 19, 1992

[86] PCT No.: PCT/JP92/00332

§ 371 Date: Nov. 19, 1992

§ 102(e) Date: Nov. 19, 1992

[87] PCT Pub. No.: WO92/16318

PCT Pub. Date: Oct. 1, 1992

[30] Foreign Application Priority Data

Mar. 22, 1991 [JP] Japan ..... 3-059022

[51] Int. Cl.[6] ..... B21J 13/08

[52] U.S. Cl. ..... 72/446; 72/389; 72/461; 483/28; 483/29

[58] Field of Search ..... 72/461, 446, 448, 389, 72/442; 483/28, 29

[56] References Cited

U.S. PATENT DOCUMENTS

| | | | |
|---|---|---|---|
| 3,938,416 | 2/1976 | Beauplat | 72/442 |
| 4,188,815 | 2/1980 | Mizushima | 72/446 |
| 4,510,789 | 4/1985 | Tomioka et al. | 72/461 |
| 4,587,830 | 5/1986 | Mills | 72/442 |
| 5,134,873 | 8/1992 | Miyagawa et al. | 72/446 |
| 5,168,745 | 12/1992 | Miyagawa et al. | 72/446 |

FOREIGN PATENT DOCUMENTS

| | | | |
|---|---|---|---|
| 0392795 | 10/1990 | European Pat. Off. . | |
| 57189624 | U 5/1956 | Japan . | |
| 59-73024 | U 11/1957 | Japan . | |
| 180209 | U 11/1962 | Japan . | |
| 55-45288 | 11/1980 | Japan . | |
| 57-37408 | 8/1982 | Japan . | |
| 57-181725A | 11/1982 | Japan . | |
| 60-213317A | 10/1985 | Japan . | |
| 62-254923A | 11/1987 | Japan . | |
| 63-21932 | 6/1988 | Japan . | |
| 9119591 | 12/1991 | WIPO . | |

OTHER PUBLICATIONS

John T. Winship, P. E., "Bending the Wright Way", Aug. 1989, pp. 20–25.

*Primary Examiner*—David Jones

*Attorney, Agent, or Firm*—Wigman, Cohen, Leitner & Myers

[57] ABSTRACT

A metal sheet processing apparatus for replacing dies with one another and for positioning a plate material in longitudinal directions. The metal sheet processing apparatus includes left and right side frames (3L, 3R), upper (5) and lower (7) tables supported by the side frames, one of the upper and lower tables serving as a vertically movable ram, and dies (17,19) disposed in a processing zone between the upper and lower tables (5, 7), for processing a plate material (W). A back gauge unit (41) is moved and positioned in longitudinal directions to position in the longitudinal directions the metal sheet (W) to be processed by the dies (17, 19). A die storage section (37) is defined behind the upper table (5). Part of the back gauge unit (41) is vertically movable and capable of supporting and replacing the dies (17, 19) between the die storage section (37) and the processing zone.

4 Claims, 7 Drawing Sheets

BENDING PRESS HAVING DIE STORAGE SECTION

TECHNICAL FIELD

This invention relates to a metal sheet processing apparatus such as a press brake for bending a metal sheet and a shearing machine for shearing a plate material.

BACKGROUND ART

A conventional metal sheet processing apparatus such as a press brake comprises left and right side frames and upper and lower tables supported by the side frames. The upper and lower tables are disposed one above another and face each other. One of the upper and lower tables serves as a vertically movable ram. An upper die is removably attached to the bottom of the upper table, and a lower die is removably attached to the top of the lower table.

The upper and lower dies are replaced with others depending on bending conditions of metal sheets.

The upper and lower dies are usually manually removed and replaced. Since the upper and lower dies are generally long (there are divided dies comprising divided short parts), it is quite troublesome to remove and attach the upper and lower dies from and to the upper and lower tables.

Accordingly, techniques for automatically attaching, detaching, and replacing the upper and lower dies have been developed. For example, there are such related arts as Japanese Examined Patent Publication Nos. 55-45288 and 57-37408 and Japanese Examined Utility Model Publication No. 63-21932.

In this way, various techniques have been developed for automatically attaching, detaching, and replacing upper and lower dies to and from upper and lower tables of a press brake. One of such techniques arranges, beside the press brake, a storage unit for storing upper and lower dies. This technique takes a large space. Another technique defines a storage section in the frame of a press brake. This technique must have a structure of preventing a back gauge unit from interfering with upper and lower dies when replacing the dies with others, and does not utilize the back gauge unit for replacing the dies.

An object of the invention is to provide a plate material processing apparatus that utilizes a back gauge unit not only for positioning a metal sheet in longitudinal directions but also for replacing upper and lower dies. Namely, the invention utilizes the back gauge unit both for replacing upper and lower dies and positioning a metal sheet.

DISCLOSURE OF THE INVENTION

To achieve the object, the invention provides a metal sheet processing apparatus comprising left and right side frames, upper and lower tables supported by the side tables, one of the upper and lower tables serving as a vertically movable ram, dies disposed in a processing zone between the upper and lower tables, for processing a plate material, a back gauge unit to be moved in longitudinal directions to position the metal sheet in the longitudinal directions, and a die storage section defined behind the upper table. Part of the back gauge unit is vertically movable and able to support and replace a die between the die storage-section and the processing zone.

With this arrangement, the back gauge unit is moved to a die stored in the die storage section behind the upper table, and part of the back gauge unit is vertically moved to support the die stored in the die storage section. While the part of the back gauge unit is supporting the die, the back gauge unit is moved in longitudinal directions to transport the die to the processing zone between the upper and lower tables.

In this way, the die is replaced between the die storage section and the processing zone.

BEST MODE OF CARRYING OUT THE INVENTION

The present invention will be explained in detail with reference to the attached drawings.

Although metal sheet processing apparatuses of the embodiments of the invention are press brakes for bending metal sheets, the invention is easily applicable for shearing machines.

Figure 1:
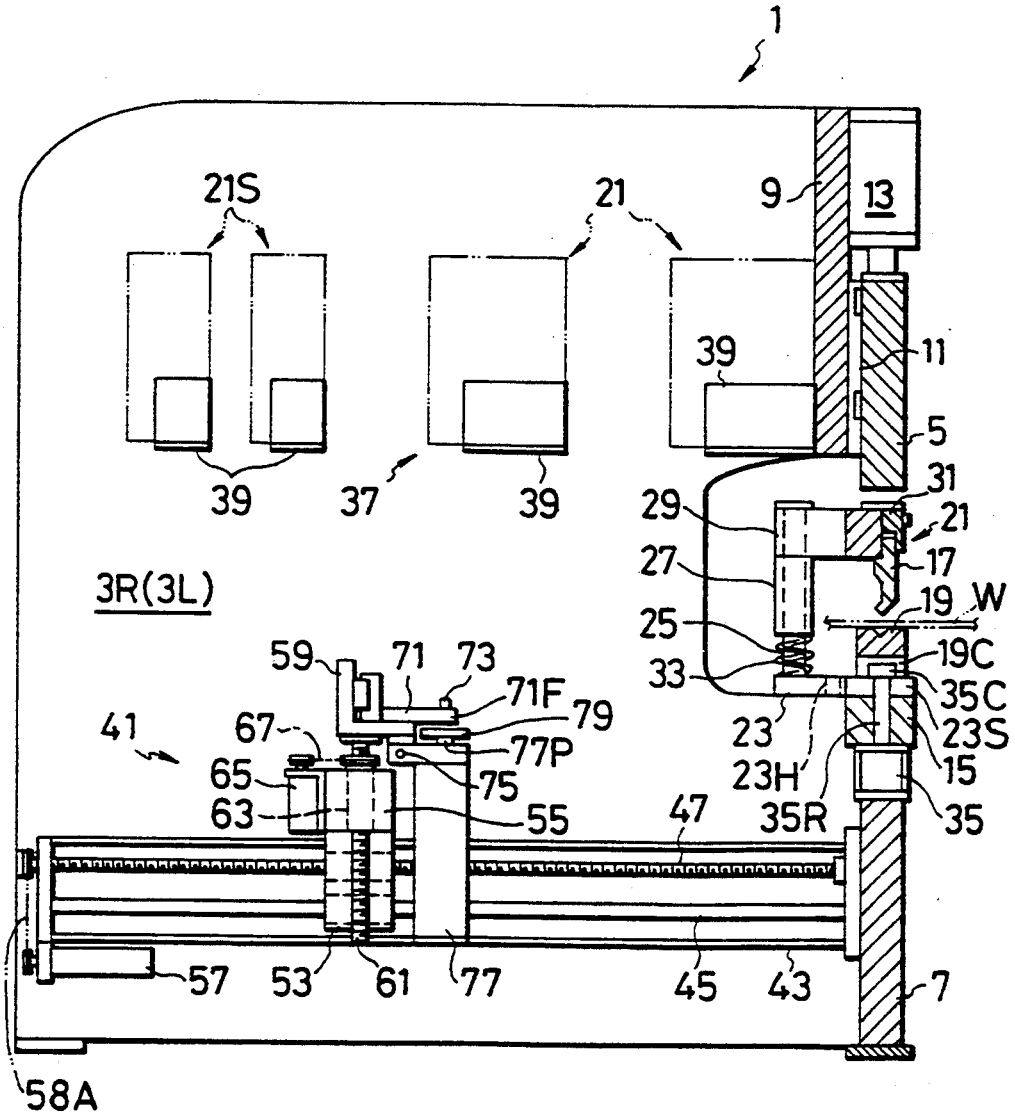
FIG. 1 is a sectional side view showing an apparatus according to a first embodiment of the invention.
Figure 2:
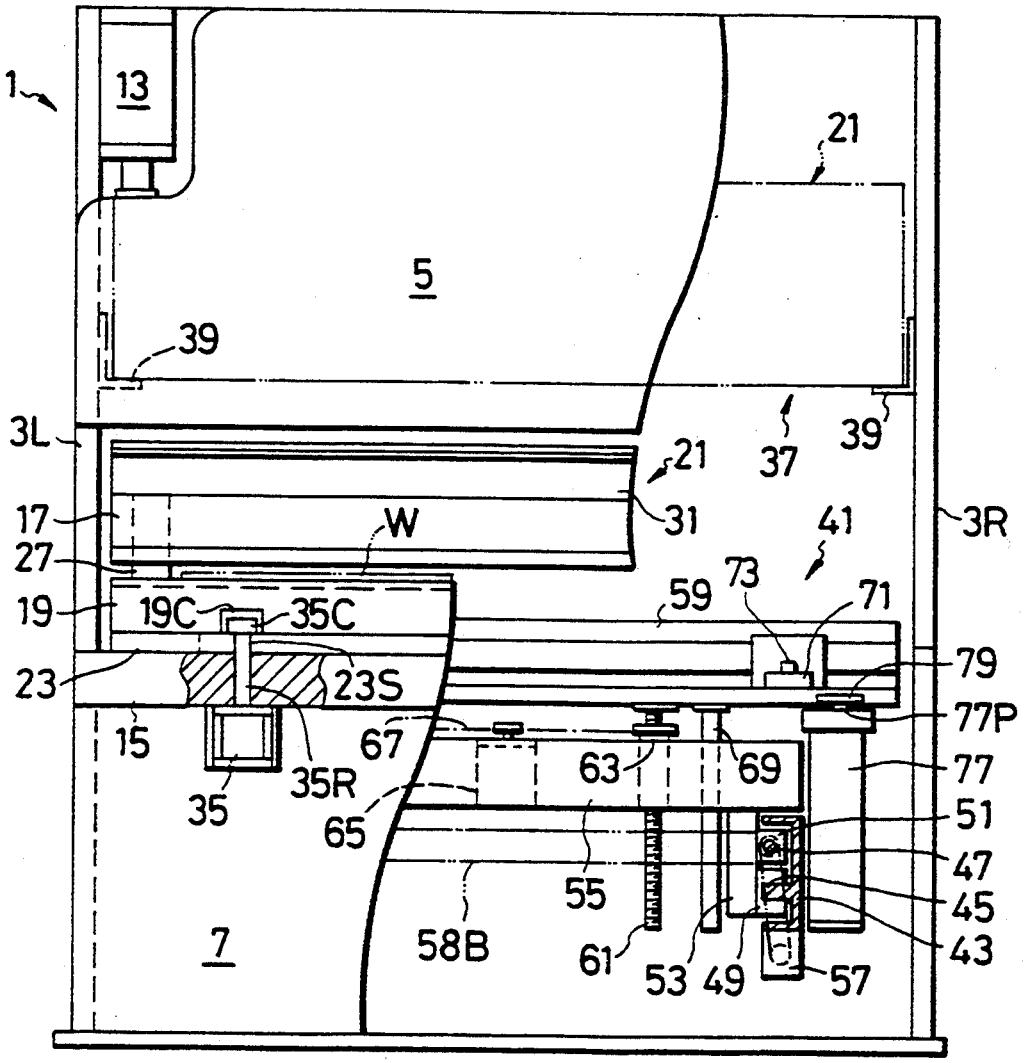
FIG. 2 is a partly broken front view showing the apparatus of first embodiment.

In FIGS. 1 and 2, the metal sheet processing apparatus, i.e., the press brake 1 comprises left and right side frames 3L and 3R. An upper table 5 is properly supported by upper parts of the side frames 3L and 3R, and a lower table 7 is properly supported by lower parts of the side frames 3L and 3R.

More precisely, upper front parts of the left and right side frames 3L and 3R are solidly connected to each other with a connection plate 9. The connection plate 9 has a plurality of vertical guides 11, which support the upper table 5 so that the upper table 5 is vertically movable. A vertical drive unit 13 such as a hydraulic cylinder is fitted to each of the left and right side frames 3L and 3R, to vertically move the upper table 5.

The lower table 7 is solidly fixed to the lower front parts of the left and right side frames 3L and 3R. A bed 15 is integrally disposed on the lower table 7.

According to the embodiment, the upper table 5 serves as a vertically movable ram. As will be understood from the following detailed explanations, the invention is easily achievable when the lower table 7 is vertically movable.

A die assembly 21 is removably attached to the bed 15. The die assembly 21 comprises an upper die 17 and a lower die 19 for bending a metal sheet W.

The die assembly 21 has a base plate 23 that extends in left and right directions. The lower die 19 is fitted to the base plate 23 by bolts, etc. A guide post 25 is uprightly disposed at each of left and right ends of the base plate 23. The guide posts 25 support an upper die holder 29 through slide sleeves 27. The upper die holder 29 extends in left and right directions and is vertically movable. The upper die 17 is removably fitted to the upper die holder 29 through a proper fixture 31. Each guide post 25 has a lifter spring 33 for always pushing up the upper die holder 29.

The die assembly 21 is fixed to the bed 15 with a plurality of fixing units 35.disposed on the lower table 7. According to the invention, each fixing unit 35 comprises a small hydraulic cylinder incorporating a fixing spring. The hydraulic cylinder has a vertically movable piston rod 35R. The top of the piston rod 35R has an integral clamp head 5C, which upwardly protrudes from the top of the bed 15.

Each clamp head 35C engages with a recess 19C formed on the lower die 19. The base plate 23 has a plurality of slits 23S each engaging with the piston rod 35R.

As will be understood from the above explanation, pressurized fluid is supplied to the fixing units 35 to release the clamp heads 35C of the fixing units 35, so that the die assembly 21 may be separated backward (leftward in FIG. 1) from the bed 15. In the other case, the slits 23S of the base plate 23 of the die assembly 21 are engaged with the piston rods 35R of the fixing units 35, and the clamp heads 35C are inserted into the recesses 19C of the lower die 19. Thereafter, the pressurized fluid is discharged from the fixing units 35, so that the springs (not shown) fix the base plate 23 to the bed 15.

After the die assembly 21 is fixed to the bed 15 as mentioned above, a metal sheet W is placed on the lower die 19, and the upper table 5 is lowered by the vertical drive units 13. As the upper table 5 descends, the upper holder 29 of the die assembly 21 descends to bend the plate material W between the upper and lower dies 17 and 19.

A die storage section 37 is defined behind the upper table 5, to store a plurality of die assemblies 21 and 21S.

More precisely, the die storage section 37 involves a plurality of L-shaped support brackets 39 fitted at proper intervals to the inner side faces of the left and right side frames 3L and 3R, to support left and right ends of the die assemblies 21 and 21S.

Figure 3:
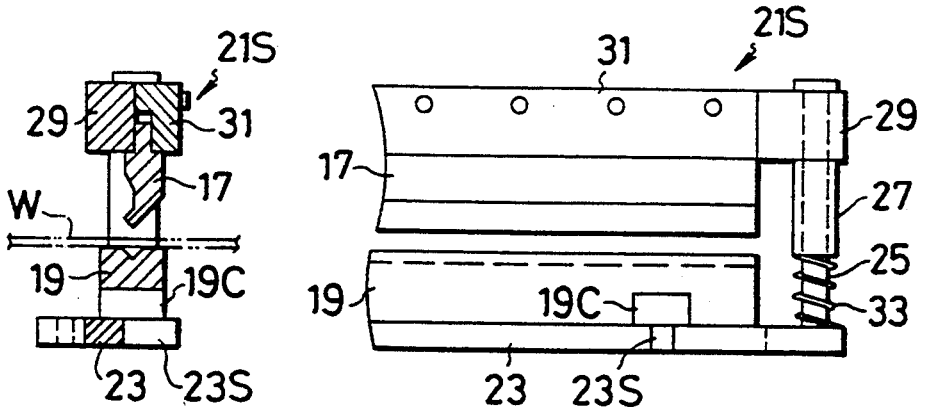
FIG. 3 shows a sectional side view and a partial front view of a die assembly.

The die assembly 21S is smaller than the die assembly 21 and has no C-shaped gap, as shown in FIG. 3. The arrangement of the die assembly 21S is substantially the same as that of the die assembly 21 except that the die assembly 21S has no C-shaped gap. The same parts of the die assembly 21S as those of the die assembly 21 are represented with like reference marks, and the detailed explanations of the die assembly 21S will be omitted.

A back gauge unit 41 positions the metal sheet W in longitudinal directions before the upper and lower dies 17 and 19 bend the metal sheet W, and replaces the die assembly 21 between the die storage section 37 and the processing zone defined between the upper table 5 and the lower table 7, i.e., the bed 15.

More precisely, a channel-shaped guide beam 43 is horizontally arranged at each of left and right sides behind the lower table 7. The guide beam 43 extends in longitudinal directions and has a longitudinally extending guide rail 45. Each guide beam 43 supports a rotatable ball screw 47.

Each bracket 53 comprises a slide block 49 that slides over the guide rail 45 and a ball nut 51 that movably meshes with the ball screw 47. The brackets 53 integrally support left and right ends of a beam 55 that is movable in longitudinal directions.

A servo motor 57 for turning the ball screws 47 is attached to one of the left and right guide beams 43. The servo motor 57 and left and right ball screws 47 are connected to each other through chains or timing belts 58A and 58B.

When the servo motor 57 is properly driven, the left and right ball screws 47 turn to move the beam 55 in the longitudinal directions through the ball nuts 51.

A vertically movable L-shaped stretch member 59 extends in left and right directions and is disposed above the beam 55 that is movable in the longitudinal directions. To vertically move the stretch member 59, an upright threaded lever 61 is arranged at each of left and right ends of the stretch member 59. Each threaded lever 61 engages with a nut member 63 that is rotatably fitted to the beam 55.

The nut members 63 are connected to a servo motor 65 for vertical movement through a chain or a timing belt 65. The servo motor 65 is fitted to the beam 55 that is movable in the longitudinal directions. A vertical guide pin 69 is uprightly arranged at each of the left and right ends of the stretch member 59, so that the guide pin 69 is vertically guided by the beam 55.

When the servo motor 65 is properly driven to turn the nut members 63, the stretch member 59 is vertically moved. The stretch member 59 may be vertically moved not only by the threaded mechanism but also by a multistage cylinder.

The stretch member 59 has a plurality of stoppers 71. The stoppers 71 protrude forward (rightward in FIG. 1) from the stretch member 59. The position of each stopper 71 is adjustable in left and right directions. Each stopper 71 has a front end face 71F to which the rear end of the metal sheet W is pressed to position the plate material W in longitudinal directions. Close to the front end face, each stopper 71 has an upright stop pin 73 that removably engages with a stop hole 23H formed in the base plate 23 of the die assembly 21.

A support cylinder 77 is rotatably supported by a shaft 75 at each of the left and right ends of the stretch member 59. The support cylinder 77 is turned around the shaft 75 by a proper actuator (not shown) to take one of vertical and horizontal positions.

A piston rod 77P reciprocates in the support cylinder 77. A front end of the piston rod 77P has a support plate 79 for supporting the bottom of the base plate 23 of the die assembly 21.

As shown in FIG. 1, the die assembly 21 is fitted to the bed 5 of the lower table 7. Replacing the die assembly 21 with another stored in the die storage section 37 and bending the metal sheet W will be explained.

At first, as shown in FIG. 1, the stretch member 59 is lowered so that the level of each stopper 71 becomes below the base plate 23 of the die assembly 21 disposed on the bed 15.

Next, the support cylinders 77 are brought to the horizontal position to avoid an interference with the lower table 7. The servo motor 57 is driven to bring the beam 55 close to the lower table 7 and place the stoppers 71 under the base plate 23 of the die assembly 21.

Thereafter, the servo motor 65 is driven to slightly raise the stretch member 59, so that the stop pins 73 of the stoppers 71 may engage with the corresponding stop holes 23H of the base plate 23 of the die assembly 21.

While the stop pins 73 are engaging with the stop holes 23H, the die assembly 21 is released from the fixing units 35, and the servo motor 57 is reversely driven to move the beam 55 backward. As a result, the die assembly 21 is pulled backward. The support cylinders 77 are returned to the original vertical position, and the piston rods 77P of the support cylinders 77 are slightly raised so that the support plates 79 support the bottom of the base plate 23 of the die assembly 21.

Thereafter, the beam 55, which is movable in the longitudinal directions, is positioned just behind vacant support brackets 39 of the die storage section 37. The servo motor 65 is driven to properly raise the stretch member 59, and the piston rods 77P of the support cylinders 77 are raised to largely ascend the die assembly 21.

After the base plate 23 of the die assembly 21 is raised higher than the support brackets 89, the servo motor 57 is forwardly driven to slightly advance the beam 55, thereby positioning the left and right ends of the die assembly 21 on the support brackets 39.

Thereafter, the piston rods 77P of the support cylinders 77 are lowered, and the stretch member 59 is also lowered, so that the die assembly 21 is supported by the support brackets 39.

In this way, the die assembly 21 is transported from the bed 15 of the lower table 7 onto the support brackets 39 of the die storage section 87. To pick up another die assembly from support brackets 39 of the die storage section 37 and fit the same onto the bed 1S of the lower table 7, the above processes will simply be carried out reversely. The operation of transporting a die assembly from the die storage section 37 onto the bed 15, therefore, will not be explained repeatedly.

Before bending the metal sheet W with the die assembly 21 fitted on the bed 15 of the lower table 7, the metal sheet W is positioned in longitudinal directions. To do this, the servo motor 65 is properly driven to vertically move the stretch member 59 to adjust the level of the front end face 71F of each stopper 71 to the level of the rear end of the metal sheet W. Then, the servo motor 57 is properly driven to move the beam 55 in the longitudinal directions to position the stopper 71 in the directions.

As explained above, the back gauge unit 41 of this embodiment is employed for attaching, detaching, and replacing the die assembly 21 as well as for positioning the metal sheet W in longitudinal directions.

Figure 4:
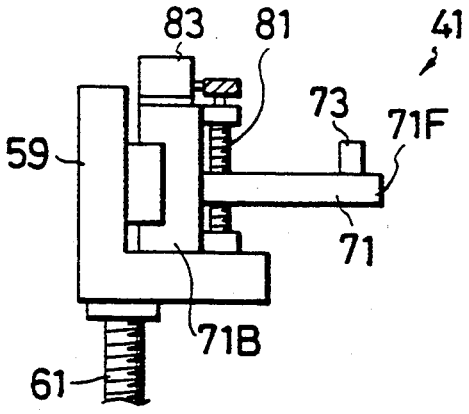
FIG. 4 is a view showing part of a modified back gauge unit.

In the above embodiment, the stop pins 73 are engaged with and disengaged from the respective stop holes 23H of the base plate 23 of the die assembly 21 by vertically moving the stretch member 59. It is also possible, as shown in FIG. 4, to rotatably arrange a threaded lever 81 on a stopper base 71B and turn the threaded lever 81 through a worm mechanism, etc., by a motor 83 fitted to the stopper base 71B. The vertical position of the stopper 71 is adjusted, and the stop pin 73 is engaged with and removed from the corresponding stop hole 23H of the base plate 23 of the die assembly 21 by driving the motor 83.

In the embodiment, the support brackets 39 are arranged at proper intervals in the die storage section 37. The support brackets 39 or horizontal support pins may be designed to protrude from and retract into the inner faces of the side frames 3L and 3R, or downwardly fold, so that each die assembly 21 may be vertically brought onto or picked up from the support brackets 39 without horizontally moving the die assembly 21.

In this case, the die assembly is not needed to be horizontally moved relative to the support brackets 39, so that the adjacent support brackets 39 may be arranged close to one another. This enables the die storage section 37 to store more die assemblies 21.

Figure 5:
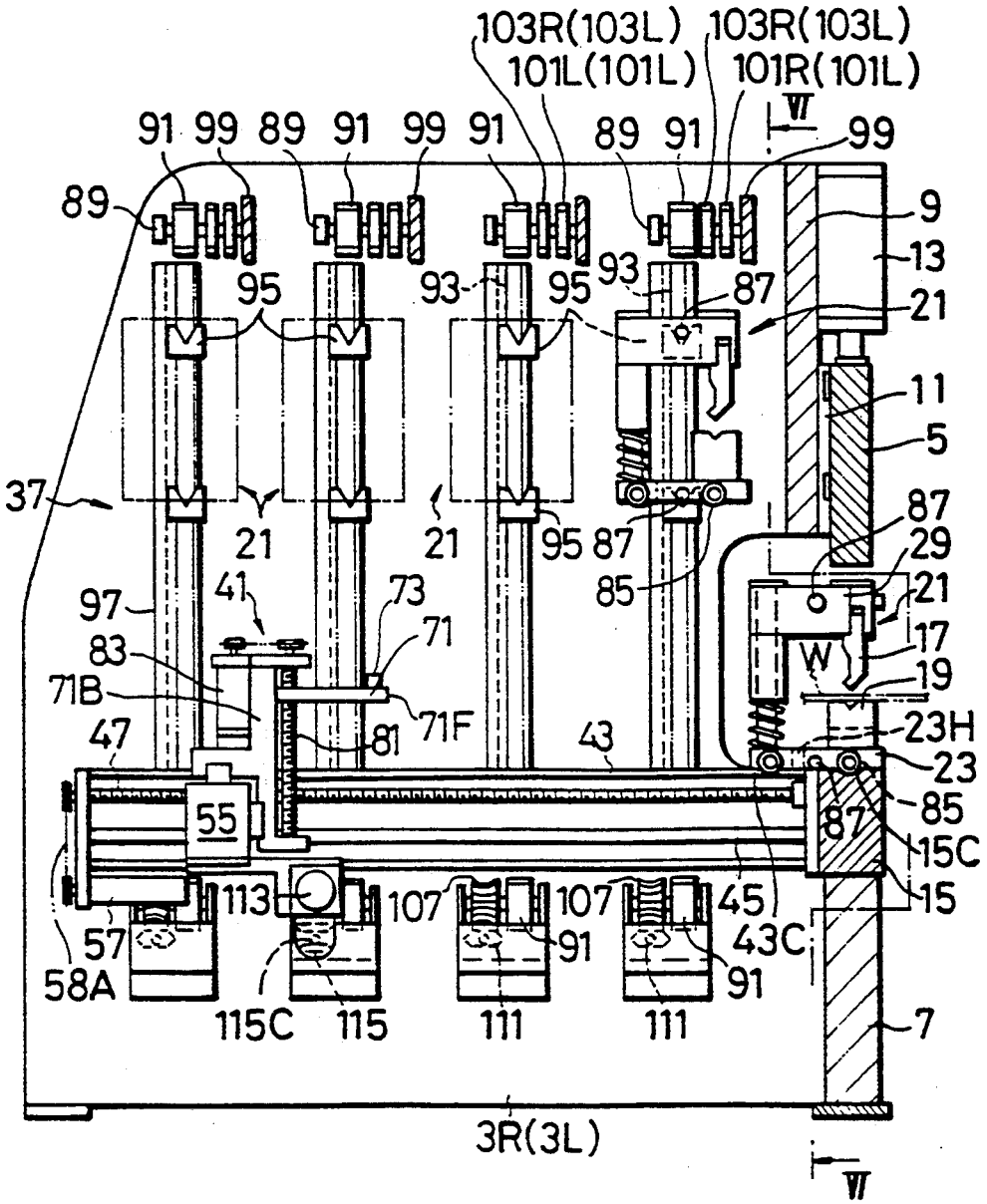
FIG. 5 sectional side view showing an apparatus according to a second embodiment.
Figure 6:
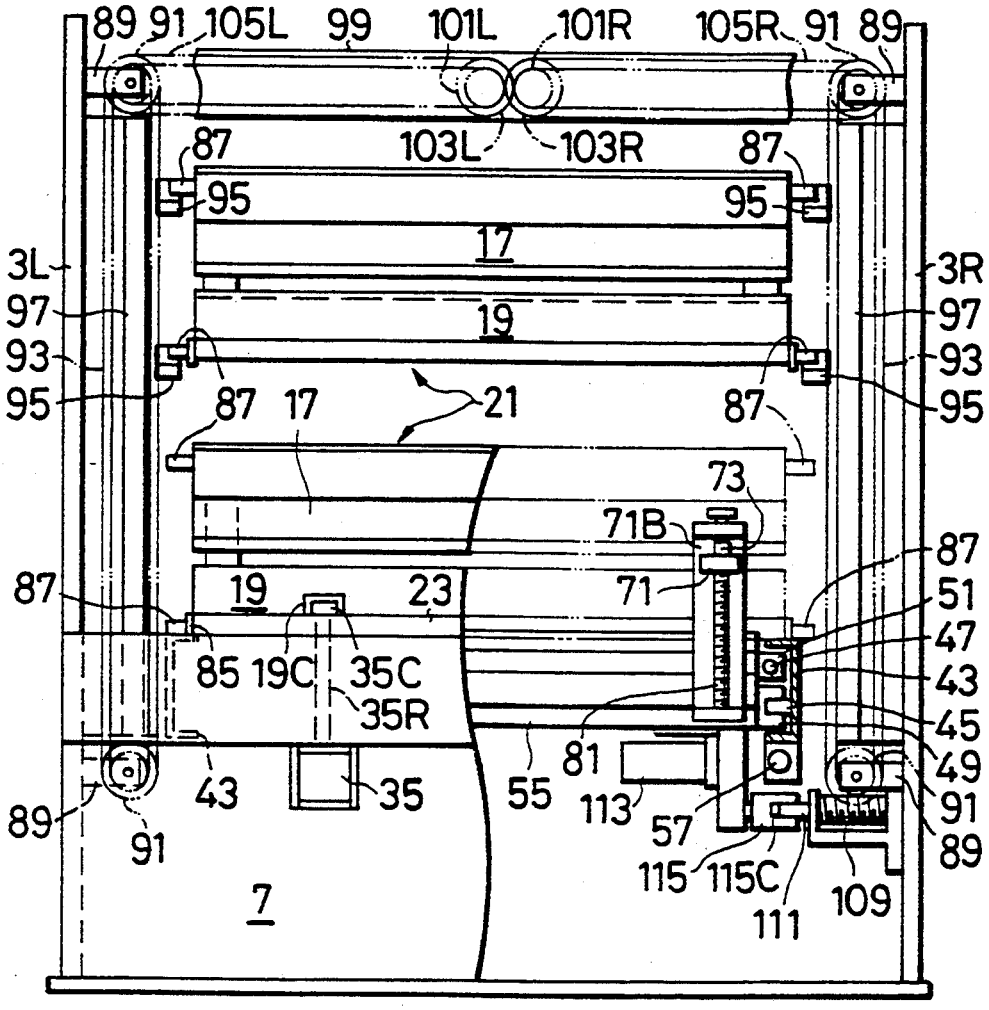
FIG. 6 is a sectional view taken along a line VI—VI of FIG. 5.

FIGS. 5 and 6 shows a second embodiment. In the second embodiment, parts having the same functions as those of the previous embodiment are represented with like reference marks and their explanations will not be repeated.

According to the second embodiment, a back gauge unit 41 is supported by left and right guide beams 43. The top faces of the guide beams 43 are flush with the top face of a bed 15 of a lower table 7. The guide beams 43 support a beam 55 so that the beam 55 is movable in longitudinal directions. Stopper bases 7B are supported by the beam 55 and movable in left and right directions. A stopper 71 is fitted to each stopper base 71B. The stopper 71 is vertically adjustable.

Each of the left and right ends of a base plate 23 of a die assembly 21 according to the second embodiment has rollers 85 that freely roll on the guide beam 43. The top faces of the guide beams 43 and bed 15 have V-shaped recesses 43C and 15C to receive the rollers 85 and position the die assembly 21.

Hook pins 87 horizontally protrude from the left and right ends of the base plate 23 and upper die holder 29 of the die assembly 21.

According to the second embodiment, a die storage section 37 has chains 93 for vertically moving die assemblies 21.

More precisely, sprockets 91 are rotatably fitted to brackets 89, which are fitted to upper and lower parts, respectively, of the inner face of each of left and right side frames 3L and 3R. Each endless chain 93 is stretched around a pair of the upper and lower sprockets 91. Each chain 93 has V-shaped hook members 95 for lifting the bottoms of the upper and lower hook pins 87 of the corresponding die assembly 21. A side of each chain 93 is supported and guided by a chain guide 97 having an L-shaped section. The chain guides 97 are fitted to the left and right side frames 3L and 3R so that the chains 93 are not bent when lifting the die assembly 21. Each pair of the left and right chains 93 are interlocked with each other. Namely, a connection beam member 99 is arranged between the left and right side frames 3L and 3R. Left and right gears 101L and 101R mesh with each other and are rotatably supported at the center of the connection beam member 99. The gears 101L and 101R have concentric chain sprockets 103L and 103R, respectively.

Each of the upper chain sprockets 91 has a double chain sprocket configuration, and left and right synchronous chains 105L and 105R are stretched around ones of the double chain sprockets 91 and the chain sprockets 103L and 103R.

A worm gear 107 is concentrically fitted to one of the left and right lower chain sprockets 91, to drive the corresponding chain 93. The worm gear 107 meshes with a worm 109. A rotary shaft of the worm 109 has a flat connection member 111.

A lifting drive motor 113 is fitted to lower part of the beam 55 that is movable in longitudinal directions. The motor 113 turns the worm 109 through the connection member 111. An output shaft of the lifting drive motor 113 has a drive connection member 115. The drive connection member 115 has a connection recess 115C that horizontally removably engages with the connection member 111.

With the above arrangement, the stoppers 71 are lowered below the top faces of the guide beams 43 in advance, and the servo motor 57 is driven to move the beam 55 in longitudinal directions so that the connection recess 115C of the drive connection member 115 of the lifting drive motor 113 fitted to the beam 55 engages with or disengages from the flat connection member 111 of the worm 109.

Accordingly, when the beam 55, which is movable in the longitudinal directions, is properly moved to take a required die assembly 21 out of the die storage section 37, the connection recess 115C of the drive connection member 115 engages with the connection member 111.

The lifting drive motor 113 is then driven to rotate the worm 109 and worm gear 107, which turn the lower right sprocket 91 shown in FIG. 6 to drive the right chain 93 in a counterclockwise direction. The rotation of the right chain 93 is transferred to the left chain 93 through the left and right synchronous chains 105L and 105R and left and right gears 101L and 101R, etc. As a result, the left chain 93 is driven in a clockwise direction in synchronism with the right chain 93.

Consequently, the hook members 95 fitted to the left and right chains 93 descend in synchronism with each other, to bring down the corresponding die assembly 21 supported by the hook members 95.

When the die assembly is lowered and the rollers 85 of the die assembly 21 are put on the guide beams 43, only the left and right chains 93 descend, so that the hook members 95 are separated away from the hook pins 87 of the die assembly 21. As a result, the die assembly becomes horizontally movable.

After the die assembly 21 is put on the guide beams 43, the motor 83 is driven to slightly lift the lowered stopper 71 so that the stop pin 73 of the stopper 71 may engage with the stop hole 23H formed in the base plate 23 of the die assembly 21.

Thereafter, the servo motor 57 is driven to advance the beam 55 to move forward the die assembly 21. When the die assembly 21 reaches onto the base 15, the rollers 85 enter into the recesses 15C and 43C, thereby positioning the die assembly 21 in the longitudinal directions. The die assembly 21 is then fixed to the bed 15 by the fixing units 35.

After the die assembly 21 is fixed, the stop pin 73 of the stopper 71 is removed from the stop hole 23H, and the beam 55 is slightly moved backward. The stopper 71 is then properly lifted to the level of a metal sheet W so that the front end face 71F of the stopper 71 gets in contact with the metal sheet W, thereby positioning the metal sheet W in the longitudinal directions.

Reversely carrying out the above processes may pull the die assembly 21 backward apart from the bed 15 and lift the same.

In this way, the stopper 71 of the back gauge unit 41 according to the second embodiment is capable of not only replacing the die assembly 21 but also positioning the metal sheet W in the longitudinal directions.

Figure 7:
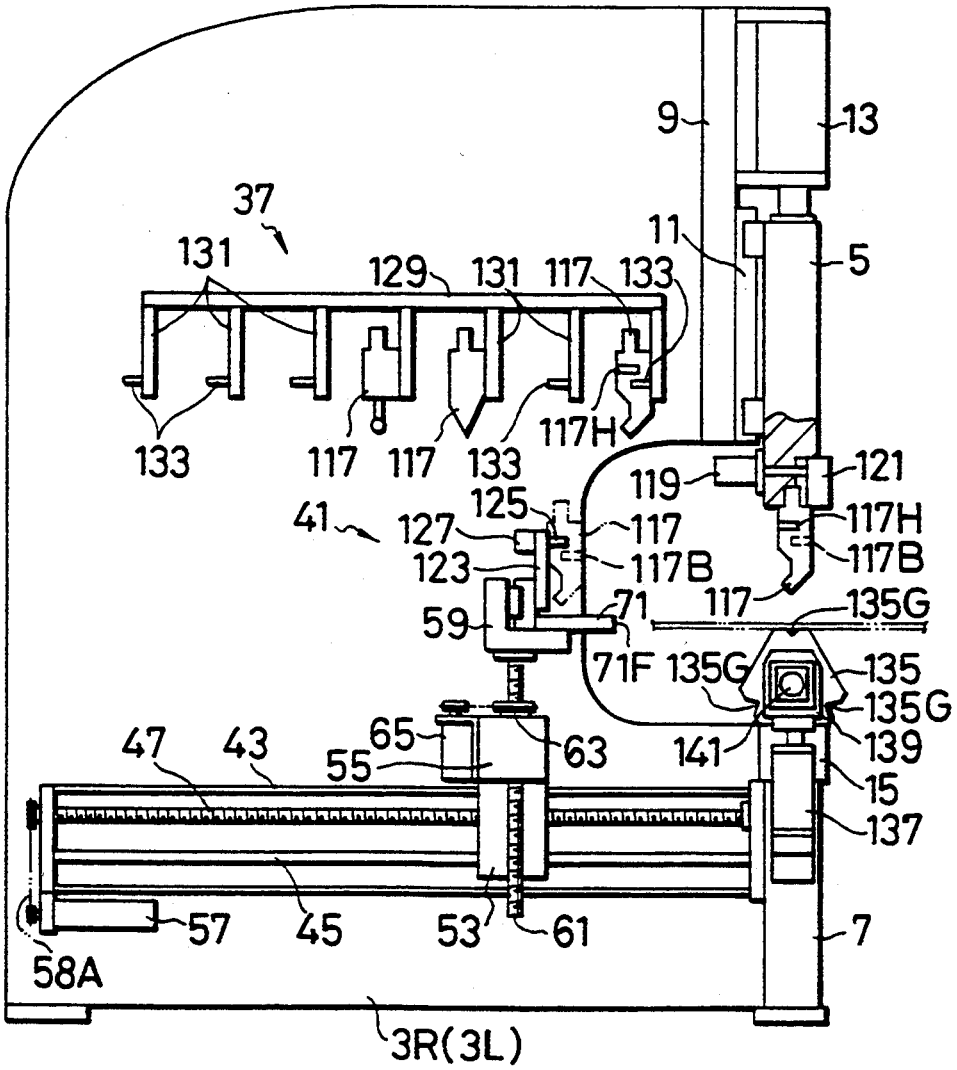
FIG. 7 is a sectional side view showing an apparatus according to a third embodiment.
Figure 8:
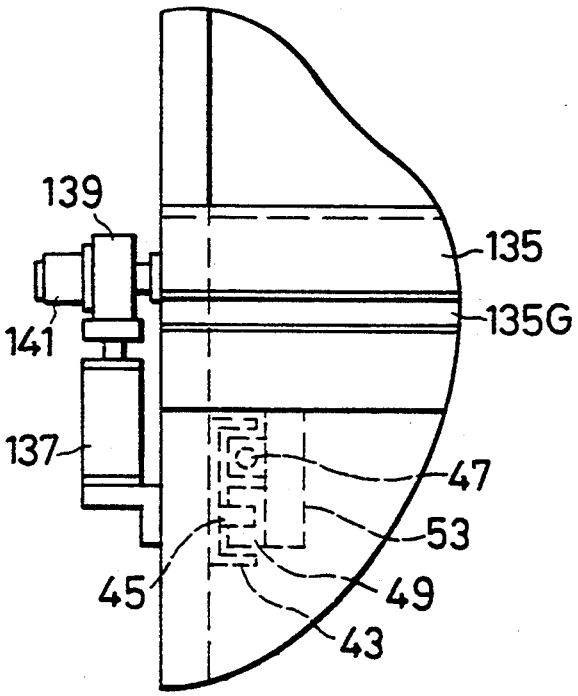
FIG. 8 is a front view showing part of the apparatus of the third embodiment.

FIG. 7 shows a third embodiment. In the figure, the same parts as those of the first embodiment are represented with like reference marks.

According to the third embodiment, any one of various kinds of upper dies 117 is attached to and detached from lower part of an upper table 5.

The lower part of the upper table 5 has a clamp jaw 121 that is activated by an actuator 119 such as an air cylinder. With the clamp Jaw 121, the upper dies 117 are replaced with one another.

To replace the upper dies 117, a back gauge unit 41 has an upper die holder 123 that is uprightly and integrally formed with a stopper 71. Upper part of the upper die holder 123 has a finger 125 that is removably engaged with an engaging hole 117H formed on a side face of the upper die 117.

The finger 125 is made of, for example, a collet whose outer diameter is expandable and reducible by an actuator 127 fitted to the upper die holder 123.

A die storage section 37 stores a plurality of upper dies 117. The die storage section 37 has a shelf frame 129 having both ends supported by left and right side frames 3L and 3R. The shelf frame 129 has a plurality of vertical support plates 131 each having horizontal stop pins 133. The stop pins 133 removably engage with stop holes 117B formed on the other side face of the upper die 117.

With the stop pins 133 engaging with the stop holes 117B, the upper die 117 is supported by the support plate 131 of the die storage section 37.

According to the third embodiment, a lower die 135 has a polygonal shape having a plurality of processing grooves 135G. Ends of the lower die 135 are rotatably supported by brackets 139, which are vertically moved by cylinders 137 fitted to the left and right side frames 3L and 3R. Each bracket 139 has a proper rotary actuator 141 for turning and indexing the lower die 135.

With the above arrangement, the cylinders 137 raise the brackets 139, and the rotary actuators 141 are activated to upwardly orient a required processing groove 135G of the lower die 135.

Selecting the upper dies 117 supported by the support plates 131 of the die storage section 37 is made by driving a servo motor 57 to move a beam 55 in longitudinal directions and position the same below a required upper die 117. A servo motor 65 is driven to lift a stretch member 59, so that the finger 125 of the upper die holder 123 may align with the fitting hole 117H of the required upper die 117 supported by the support plate 131.

The servo motor 57 is again driven to slightly advance the beam 55, so that the finger 125 may enter into the fitting hole 117H of the upper die 117. The actuator 127 is activated to expand the outer diameter of the finger 125, thereby strongly engage the finger 125 with the fitting hole 117H of the upper die 117.

The servo motor 57 is reversely driven to move the beam 55 backward, so that the stop pins 133 of the support plate 131 are released from the stop holes 117B of the upper die 117. The servo motor 65 is reversely driven to descend the stretch member 59, and the servo motor 57 is again driven to advance the beam 55 that is movable in the longitudinal directions.

The upper die 117 is positioned below the upper table 5 and strongly held by the clamp jaw 121. The outer diameter of the finger 12S is reduced, and the finger 125 is removed from the fitting hole 117H of the upper die 117, thereby completing the fitting of the upper die 117 to the upper table 5.

Oppositely carrying out the above processes will easily remove the upper die 117 from the upper table 5 and store the same onto the support plate 131 of the die storage section 37.

As is apparent from the above explanation, the back gauge unit 41 of the third embodiment is capable of not only replacing the upper dies 117 with one another but also positioning the metal sheet W in longitudinal directions.

CAPABILITY OF EXPLOITATION IN INDUSTRY

As is understood through the explanations of the embodiments, the invention employs a back gauge unit not only for replacing dies with one another but also for positioning a metal sheet in longitudinal directions. A metal sheet processing apparatus provided by the invention is, therefore, compact and simple.

We claim:

1. A bending press comprising:

left and right side frames;

upper and lower tables supported by the side rames, one of the upper and lower tables serving as a vertically movable ram;

means for moving the movable ram;

dies disposed in a processing zone between the upper and lower tables, for processing a metal sheet, the dies having longitudinal axes that are parallel to each other;

a die storage section for storing dies to be introduced into said processing zone, said die storage section provided at a position behind the upper table;

a back gauge unit provided behind the upper and lower tables, the back gauge unit being movable along an axis that is perpendicular to the longitudinal axes of the dies, for positioning a metal sheet relative to the dies; and supporting means provided on the back gauge unit, for supporting and transferring said dies to be introduced into said processing zone.

2. The bending press according to claim 1, wherein the dies stored in the die storage section and the dies in the processing zone involve replaceable assemblies are each formed of an upper die and a lower die.

3. The bending press according to claim 1, wherein the dies stored in the die storage section and the dies in the processing zone involve replaceable upper dies.

4. The bending press as claimed in claim 1, wherein said transferring means is movable in the vertical direction.

* * * * *